US005860833A

United States Patent [19]

Chillscyzn et al.

[11] Patent Number: 5,860,833

[45] Date of Patent: Jan. 19, 1999

[54] ELECTRICAL CONNECTOR HAVING A PROBE POSITIONABLE BETWEEN A PAIR OF SPACED POSITIONS

[75] Inventors: Steven A. Chillscyzn; Anthony A. Hidalgo, both of Thousand Oaks, Calif.

[73] Assignee: Trompeter Electronics, Inc., Westlake Village, Calif.

[21] Appl. No.: 848,796

[22] Filed: May 1, 1997

[51] Int. Cl.[6] ..... H01R 9/05

[52] U.S. Cl. ..... 439/585

[58] Field of Search ..... 439/585, 586

[56] References Cited

FOREIGN PATENT DOCUMENTS 0122700 10/1908 European Pat. Off. ..... 439/585
0186339 2/1986 European Pat. Off. ..... 439/585

*Primary Examiner*—Neil Abrams
*Assistant Examiner*—Jean F. Duverne
*Attorney, Agent, or Firm*—Ellsworth R. Roston; Fulwider Patton Lee & Utecht, LLP

[57] ABSTRACT

A probe is disposed in an axial opening in an insulator. The wall defining the axial opening has an internal projection and the probe has a mating recess to define with the projection a detent relationship limiting the axial movement of the probe in a first direction. A shoulder on the probe abuts an insulator to limit the probe movement axially in a second direction opposite to the first direction. The probe has a bayonet portion positioned to engage a female member in a first connector with the probe in the second detent relationship. A ferrule on the insulator has a portion crimpable on the insulator to retain the insulator and the ferrule in a fixed relationship. A nut on the ferrule is fixedly retained between a lug on the ferrule and a sleeve on the ferrule. The probe end opposite the bayonet portion has a socket for receiving a pin in a cable. The cable has an insulator which can be disposed in the space within the ferrule. The ferrule has a plurality of annularly spaced fingers which extend in a direction away from the probe bayonet portion and which have prongs on their outer ends. The fingers are spaced from a crimpable portion on the sleeve. Conductive braiding on the insulator in the cable is disposed between the fingers and the sleeve crimpable portion and is fixedly retained by the prongs on the fingers and the crimping of the sleeve.

24 Claims, 1 Drawing Sheet

ELECTRICAL CONNECTOR HAVING A PROBE POSITIONABLE BETWEEN A PAIR OF SPACED POSITIONS

This invention relates to electrical connectors. More particularly, the invention relates to electrical connectors for providing a positioning of a probe between a pair of fixed positions displaced from each other.

BACKGROUND OF THE INVENTION

Electrical connectors have been known for many years. They provide a coupling between an input such as a pair of cables displaced from each other so that signals from one of the cables will pass into the other cable without any appreciable loss of signal strength or power between the cables. In the past several decades, literally thousands, and probably tens of thousands, of different connectors have been manufactured and sold.

It has been difficult to provide a connector with a centrally disposed probe which is movable between two (2) fixed positions. In one of these positions, the probe is intended to be disposed to be connected relatively easily to the central conductor of a first coupling member such another electrical connector. In the second position, the probe is intended to be disposed to be connected relatively easily to the central conductor of a second coupling member such as a coaxial cable. It has been especially difficult to provide a connector with such characteristics where the connector is relatively simple and straightforward in construction and is provided with a minimal number of parts and where the different elements in the cable are fixedly positioned relative to the connector.

BRIEF DESCRIPTION OF THE INVENTION

In one embodiment of the invention, a probe is disposed in an axial opening in an insulator. The wall defining the axial opening has an internal projection and the probe has a mating recess to define with the projection a detent relationship limiting the axial movement of the probe in a first direction. A shoulder on the probe abuts an insulator to limit the probe movement axially in a second direction opposite to the first direction. The probe has a bayonet portion positioned to engage a female member in a first connector with the probe in the second detent relationship.

A ferrule on the insulator has a portion crimpable on the insulator to retain the insulator and the ferrule in a fixed relationship. A nut on the ferrule is fixedly retained between a lug on the ferrule and a sleeve on the ferrule. The probe end opposite the bayonet portion has a socket for receiving a pin in a cable. The cable has an insulator which can be disposed in the space within the ferrule. The ferrule has a plurality of annularly spaced fingers which extend in a direction away from the probe bayonet portion and which have prongs at their outer ends. The fingers are spaced from a crimpable portion on the sleeve. Conductive braiding on the insulator in the cable is disposed between the fingers and the sleeve crimpable portion and is fixedly retained by the prongs on the fingers and the crimping of the sleeve.

DETAILED DESCRIPTION OF THE INVENTION

Figure 1:
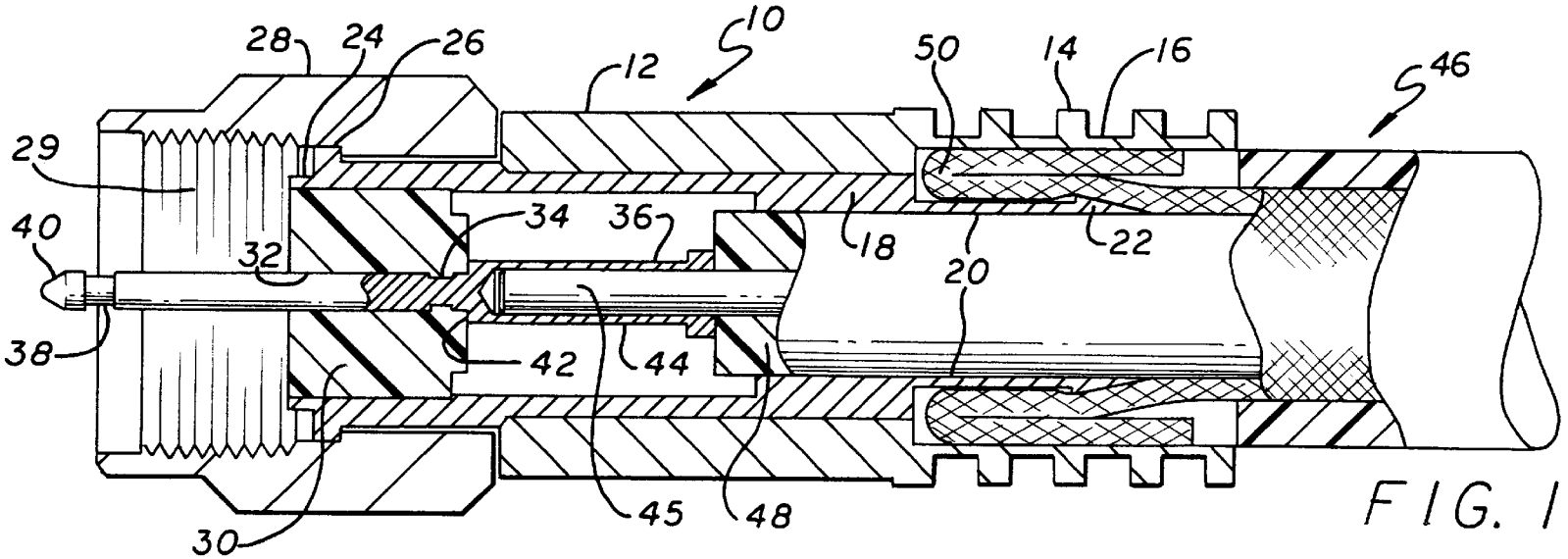
FIG. 1 is a sectional view of an electrical connector constituting one embodiment of the invention and shows a probe in one position in the connector.

In one embodiment of the invention, a connector generally indicated at 10 is shown. The connector 10 includes a hollow sleeve 12 made from a suitably conductive material. The sleeve 12 is provided at one end with a stepped configuration defined by a plurality of alternately spaced thick portions 14 and thin portions 16. The sleeve is disposed on a hollow ferrule 18 made from an electrically conductive material. At the same end as the thick and thin portions 14 and 16 on the sleeve 12, the ferrule 18 has a plurality of resilient fingers 20 which are annularly spaced from one another around the periphery of the ferrule. Each of the fingers 20 has a prong 22 at the end of the finger.

At its other end, the ferrule 18 has a crimpable portion 24. A lug 26 is disposed on the ferrule 18 near the crimpable portion 24. A nut 28 is disposed on the ferrule 18 and is captured between the lug 26 on the ferrule and the sleeve 12. The nut 28 is internally threaded as at 29 to be coupled to an outer insulator in a connector (not shown) in a manner known in the prior art. An insulator 30 is disposed within the ferrule 18 at a position adjacent the crimpable portion 24 and the lug 26. The insulator 30 is fixedly retained within the ferrule 18 by crimping the portion 24 against the insulator.

The insulator 30 is provided with an axially disposed bore 32 and an internal projection 34 is disposed within the bore. A probe 36 is adapted to be disposed within the bore 32 for axial movement within the bore. The probe 36 is provided with a recess 38 at one end. A bayonet shaped coupling portion 40 is disposed on the probe 36 adjacent the recess 38 to become coupled to a female member in the connector (not shown) in a manner well known in the prior art. At its other end, the probe 36 is provided with a shoulder 42 which abuts the insulator 30 to limit the movement of the probe to the left as shown in FIG. 1.

The probe 36 is provided with a female portion 44 at the end opposite the recess 38 to receive a central conductor 45 in a cable generally indicated at 46. An insulator 48 on the cable 46 is disposed in the ferrule 18. An electrically conductive braiding 50 on the insulator 48 extends into the space between the fingers 20 on the ferrule 18 and the thick portions 14 and thin portions 16 on the sleeve 12. The thin portions 16 on the sleeve 12 are then crimped to position the electrically conductive braiding 50 fixedly between the prongs 22 on the ferrule fingers 20 and the crimped portions 16 of the sleeve.

Figure 2:
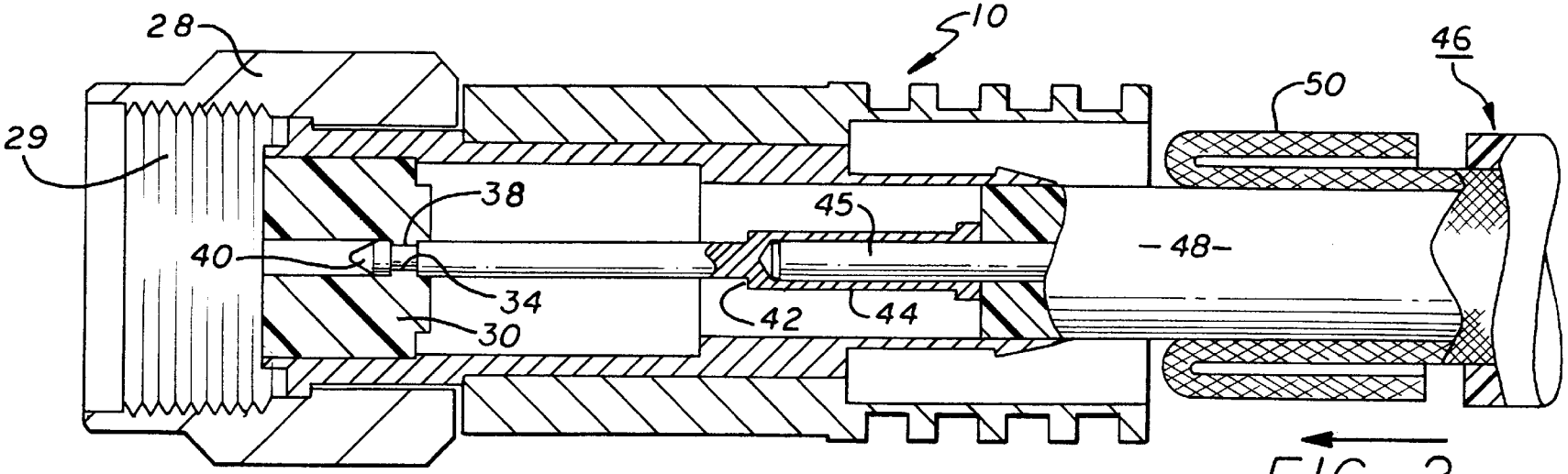
FIG. 2 is a sectional view of the electrical conductor shown in FIG. 1 and shows the probe in a second position in the connector.

In the position of the probe 36 shown in FIG. 1, the shoulder 42 on the probe abuts the insulator 30 to limit the axial movement of the probe toward the left. In this position, the bayonet shaped coupling portion 40 extends outwardly from the nut 28 to provide for a coupling of the probe 36 to the female member in the connector (not shown). In the position shown in FIG. 2, the probe 36 is retained in fixed position by the detent relationship between the internal projection 34 in the bore 32 of the insulator 30 and the recess 38 in the probe 36. In this position, the female portion 44 of the probe 36 is near the open end of the ferrule 18 so that the central conductor 45 in the cable 46 can be easily inserted into the female portion and the electrically conductive braiding 50 can be easily inserted into the space between the fingers 20 and the thick portions 14 and thin portions 16 on the sleeve 12. The electrically conductive braiding 50 is retained in fixed position between the fingers 20 on the ferrule 18 and the sleeve 12 by crimping the thin portions 16 on the electrically conductive braiding.

Although this invention has been disclosed and illustrated with reference to particular embodiments, the principles involved are susceptible for use in numerous other embodiments which will be apparent to persons of ordinary skill in the art. The invention is, therefore, to be limited only as indicated by the scope of the appended claims.

We claim:

1. A connector, including, a probe having a detent near a first end and having a shoulder near a second end opposite the first end, an insulator having a central opening for receiving the probe in a pass-through relationship and having a detent for co-operating with the detent on the probe to retain the probe in a particular relationship with the insulator with the probe partially extending through the insulator and to provide for the coupling of a central conductor of a cable to the second end of the probe, the probe being movable to a second relationship in which the shoulder on the probe abuts the insulator, a ferrule disposed on the insulator, a sleeve disposed on the ferrule, and a nut disposed on the ferrule and the sleeve.

2. A connector as set forth in claim 1, including, the nut being disposed on the ferrule and the sleeve in a confined relationship with the ferrule and the sleeve.

3. A connector as set forth in claim 1, including, the sleeve having a crimpable portion for the disposition of conductive braiding on the cable between the sleeve and the ferrule and for the crimping of such crimpable portion against the conductive braiding on the cable.

4. A connector as set forth in claim 1, including, the ferrule having a portion disposed on the insulator and crimpable on the insulator to retain the insulator and the ferrule in a fixed relationship.

5. A connector as set forth in claim 1, including, the ferrule having fingers at one end for disposition of the conductive braiding between the crimpable portion of the sleeve and the fingers on the ferrule.

6. A connector as set forth in claim 3, including, the ferrule being provided at one end with a plurality of prongs for receiving the conductive braiding between the crimpable portion of the sleeve and the prongs.

7. A connector as set forth in claim 2, including, the sleeve having a crimpable portion for the disposition of conductive braiding on the cable between the sleeve and the ferrule and for the crimping of such crimpable portion against the conductive braiding on the cable, the ferrule having a portion disposed on the insulator and crimpable on the insulator to retain the insulator and the ferrule in a fixed relationship, the ferrule having fingers at one end for disposition of the conductive braiding between the crimpable portion of the sleeve and the fingers on the ferrule, the ferrule being provided at one end with a plurality of prongs for receiving the conductive braiding between the crimpable portion of the sleeve and the prongs.

8. A connector, including, a ferrule, a sleeve disposed on the ferrule, a nut disposed on the ferrule, the ferrule and the sleeve being disposed relative to each other and being constructed to retain the nut between the ferrule and the sleeve, an insulator disposed within the ferrule in a fixed relationship to the ferrule, and a probe disposed within the insulator and having a detent relationship with the insulator in a first position of the probe, the probe being movable within the insulator between the first position and a second position, the probe extending in the second position from the insulator and being disposed in the first position within the insulator to receive the central conductor of a cable.

9. A connector as set forth in claim 8, including, the probe having a bayonet configuration at a first end and the bayonet configuration at the first end extending from the insulator in the first position of the probe and receptacle, at a second end opposite the first end, for receiving the central conductor of the cable.

10. A connector as set forth in claim 8, including, the insulator having a central opening defined by an inner wall in the insulator, the detent relationship being defined by an internal projection on the inner wall of the insulator and by a recess in the probe.

11. A connector as set forth in claim 8, including, a crimpable portion disposed on the ferrule at one end of the ferrule for crimping on the insulator to maintain the ferrule and the insulator in a fixed relationship.

12. A connector as set forth in claim 8, including, fingers disposed on the ferrule at one end of the ferrule for maintaining a conductive braiding on the cable in a fixed relationship between the ferrule fingers and the sleeve.

13. A connector as set forth in claim 8, including, a plurality of thick and thin portions disposed in spaced relationship on the sleeve for receiving conductive braiding on the cable between such thick and thin portions on the sleeve and for providing for the crimping of the thin portions of the sleeve against the conductive braiding.

14. A connector as set forth in claim 8, including, the nut being disposed at one end against the sleeve and defining at the other end a detent relationship with the ferrule to retain the nut in a fixed relationship with the sleeve and the ferrule.

15. A connector as set forth in claim 8, including, the insulator having a central opening defined by an inner wall in the insulator, the detent relationship being defined by an internal projection on the inner wall of the insulator and by a recess in the probe, a crimpable portion disposed on the ferrule at a first end of the ferrule for crimping on the insulator to maintain the ferrule and the insulator in a fixed relationship, and prongs disposed on the ferrule at a second end of the ferrule opposite the first end.

16. A connector as set forth in claim 15, including, a crimpable portion disposed on the ferrule at one end of the ferrule for crimping on the insulator to maintain the ferrule and the insulator in a fixed relationship, fingers disposed on the ferrule at one end of the ferrule for maintaining a conductive braiding on the cable in a fixed relationship between the ferrule fingers and the sleeve, a plurality of thick and thin portions disposed in spaced relationship on the sleeve for receiving conductive braiding on the cable between such thick and thin portions on the sleeve and for providing for the crimping of the thin portions of the sleeve against the conductive braiding, the nut being disposed at one end against the sleeve and defining at the other end a detent relationship with the ferrule to retain the nut in a fixed relationship with the sleeve and the ferrule.

17. A connector, including, a ferrule, a sleeve disposed on the ferrule, a nut retained by the ferrule and the sleeve, an insulator disposed within the ferrule, the insulator having a central opening and having a first detent disposed in the central opening, and a probe disposed in the central opening in the insulator and movable in the central opening in the insulator and having a second detent co-operative with the first detent in a first position of the probe in the opening to retain the probe in such first position, the probe being movable to a second position in the opening, the probe being disposed in the first position to provide for a connection with a connector pin and being disposed in the second position to receive a central conductor in a cable.

18. A connector as set forth in claim 17, including, the ferrule, the sleeve, the nut, the insulator and the probe being cylindrical and the central opening in the insulator extending axially through the insulator, one of the detents constituting a projection and the other detent constituting a recess mating with the projection.

19. A connector as set forth in claim 18, including, the detent in the probe being near one end of the probe to limit the movement of the probe in the opening in the insulator in a first direction and prevent the probe from being removed from the opening in the insulator and a shoulder on the probe being disposed near a second end of the probe to limit the movement of the probe in the opening in the insulator in a second direction opposite to the first direction.

20. A connector as set forth in claim 19, including, the ferrule being disposed on the insulator and having a portion crimpable on the insulator to retain the ferrule and the insulator in a fixed relationship.

21. A connector as set forth in claim 19, including, the ferrule having a shoulder at a first position, the sleeve being disposed against the shoulder, the ferrule having a lug at a position displaced axially from the shoulder, the nut being retained in a fixed relationship on the ferrule between the sleeve and the lug.

22. A connector as set forth in claim 19, including, the ferrule having a shoulder at a first position, the sleeve being disposed against the shoulder, the sleeve having a portion displaced from the shoulder on the ferrule for receiving a conductive braiding on the cable and for fixedly holding the conductive braiding in a crimped relationship to the sleeve.

23. A connector as set forth in claim 19, prongs on the ferrule at one end of the ferrule for holding a conductive braiding on the cable in a fixed relationship between the ferrule and the sleeve.

24. A connector as set forth in claim 20, including, thick and thin portions alternately spaced on the sleeve at one end of the sleeve for receiving and retaining conductive braiding on the cable between the ferrule and the sleeve in a crimped relationship with the sleeve, pronged fingers on the ferrule at one end of the ferrule for receiving and retaining the conductive braiding on the cable between the pronged fingers and the sleeve, the ferrule having a shoulder at a first position, the end of the sleeve opposite the one end being disposed against the shoulder in the ferrule, and a crimpable portion on the ferrule at a second end of the ferrule opposite the one end of the ferrule for crimping on the insulator to retain the insulator and the ferrule in a fixed relationship.

* * * * *